United States Patent [19]

Martin

[11] Patent Number: 4,964,174

[45] Date of Patent: Oct. 23, 1990

[54] GLOVES FOR MECHANICS

[76] Inventor: Linda M. Martin, 3H Research Rd., Greenbelt, Md. 20770

[21] Appl. No.: 304,180

[22] Filed: Jan. 31, 1989

[51] Int. Cl.[5] ..... A41D 19/00

[52] U.S. Cl. ..... 2/161 R; 2/163; 2/164

[58] Field of Search ..... 2/159, 164, 163, 161 R, 2/167, 161 A, 16, 20

[56] References Cited

U.S. PATENT DOCUMENTS

| | | | |
|---|---|---|---|
| 325,968 | 9/1885 | Rawlings | 2/164 X |
| 651,701 | 6/1900 | Delamere | 2/159 |
| 852,972 | 5/1907 | Mackay | 2/161 R |
| 1,235,010 | 7/1917 | Charney | 2/161 R |
| 1,358,824 | 11/1920 | Burden | 2/161 R |
| 2,041,201 | 5/1936 | Neback | 2/161 R |
| 2,114,022 | 4/1938 | Jensen | 2/161 R |
| 2,705,327 | 4/1955 | Gitt, 2nd | 2/161 R |
| 4,507,807 | 4/1985 | Karkanen | 2/161 R |
| 4,748,693 | 6/1988 | Shinn | 2/161 R X |

FOREIGN PATENT DOCUMENTS

| | | | |
|---|---|---|---|
| 154611 | 6/1953 | Australia | 2/161 R |
| 0050081 | 4/1982 | European Pat. Off. | 2/164 |
| 1200432 | 12/1959 | France | 2/161 R |
| 2598064 | 11/1987 | France | 2/159 |
| 2134371 | 8/1984 | United Kingdom | 2/159 |

*Primary Examiner*—Werner H. Schroeder
*Assistant Examiner*—Sara M. Current
*Attorney, Agent, or Firm*—Oblon, Spivak, McClelland, Maier & Neustadt

[57] ABSTRACT

A protective glove pair, comprising an outer glove and an inner glove within the outer glove, the inner glove being optionally removable from the outer glove, wherein the outer glove comprises a glove body and protective finger and thumb portions, the protective portions comprising open-ended tubes from the glove body to cover the fingers and thumb to a distance between the metacarpophalangeal joints and the distal knuckle of each finger and thumb, and the inner glove being flexible and tight fitting to the hand and comprising a natural or synthetic rubber or synthetic polymer.

6 Claims, 1 Drawing Sheet

GLOVES FOR MECHANICS

BACKGROUND OF THE INVENTION

1. Field of the Invention

The invention relates to gloves comprising an outer glove and an inner glove within the outer glove, where the inner glove is optionally removable from the outer glove.

2. Discussion of the Background

Protective gloves are known for protecting the hands of the wearer from various types of external abrasion, heat, temperature and toxic or corrosive chemicals. Ideally, protective gloves serve to protect the delicate bones and tissues of the wearers hand from injury while at the same time not limiting the user's finger dexterity. A particularly difficult problem is protection of the hand against a combination of environmental factors such as abrasion and heat when these environmental factors occur in a chemical environment. Protect on of the wearer from toxic and corrosive chemicals or solvents presents a unique challenge to the design of protective gloves.

Protective gloves designed to protect against friction and abrasion and retain finger dexterity are known in the art. For example, U.S. Pat. No. 4,561,122 describes a leather glove primarily designed for use in absorbing trauma to the hand of the user during such games as baseball and softball. The leather glove has finger and palm pads for absorbing shock and thick leather portions for reducing abrasion while at the same time not interfering with dorsal resistance and wrap-around grasp of the hand. Tactile sensation is maintained by leaving the fingertips uncovered.

Similar fingerless gloves are disclosed in U.S. Pat. No. 2,314,545 which discloses a glove having a large opening at the dorsal side of the hand and U.S. Pat. No. 4,519,097 which discloses a fingerless-glove-for use in playing arcade games. This latter glove has a relatively large opening between the thumb and forefinger and leaves the forefinger substantially uncovered. Clearly, gloves which leave uncovered substantial portions of the hand are unsatisfactory as protective gloves in a corrosive chemical or solvent environment.

Surgical gloves are known which are made primarily from natural and synthetic rubber compositions. The surgical gloves are flexible and fit the hand with a skin-tight fit. Such gloves are substantially impervious to aqueous fluids such as blood, and maintain substantial tactile sensitivity in the fingertips necessary for intricate surgical procedures and the handling of small surgical instruments. However, conventional surgical gloves lack the structural strength and resilience necessary to protect against friction and abrasion. Surgical gloves and other types of rubber gloves (lined or unlined) are inadequate for use in greasy or oily environments. When the rubber gloves become coated with grease or oil, the lubricating effect of the grease or oil impairs the users ability to handle tools safely. Further, conventional rubber or surgical gloves are completely ineffective in protecting against high temperatures such as are encountered in the handling of hot glassware and chemical apparatus.

Accordingly, a need continues to exist for protective gloves which protect against abrasion, heat and chemical environments and which are flexible, while at the same time enabling one to utilize the sensitive fingertips for performing small scale and fine fingertip manipulation.

SUMMARY OF THE INVENTION

Accordingly, one object of the present invention is to provide a protective glove which protects a substantial portion of the hand from high temperatures and abrasion. The glove should be sufficiently flexible so as not to interfere with manual dexterity and yet provide adequate protection and gripping friction under greasy or oily conditions. A further object is to provide a protective glove which combines protection against chemical solvents and corrosive chemicals with protection against heat and abrasion and yet which allows for good sensitivity in the fingertips so that one may perform detailed and delicate finger manipulations.

These and other objects which will become apparent from the following specification have been achieved by the present protective glove which comprises an outer glove and an inner glove within the outer-glove, where the inner glove is optionally removable from the outer glove and where the outer glove comprises a glove body and protective fingers and thumb portions, said protective portions comprising open-ended tubes from the glove body to cover the fingers and thumb to a distance between the metacarpophalangeal joints and the distal knuckles of each finger and thumb, and the inner glove is flexible and tight fitting to the hand and comprises a natural or synthetic rubber or synthetic polymer.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing wherein:

FIG. 1B shows inner glove 3.

DETAILED DESCRIPTION OF THE PREFERRED EMBODIMENTS

Figure 1A:
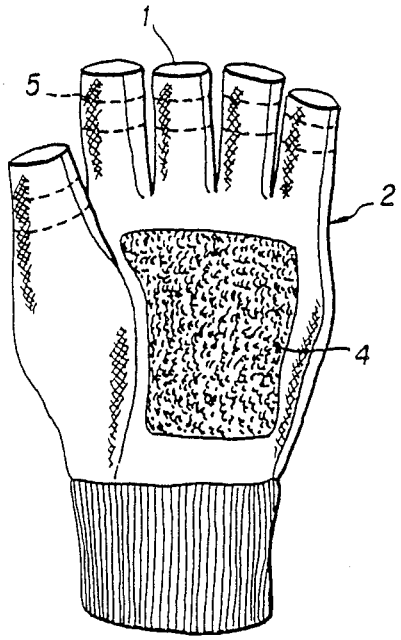
FIGS. 1A and 1B illustrate one embodiment of the inner and outer gloves which make up the combined protective glove of the present invention. Outer glove 2 has open finger tips 1 and removable identified segments 5. Outer glove 2 may also have a rough material or interlocking nylon on the palm area 4, as shown in FIG. 1A.
Figure 1B:
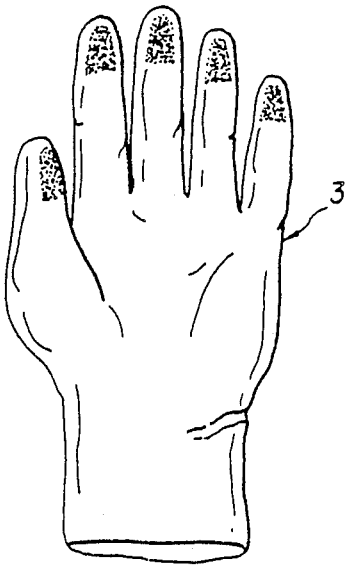

The gloves of the present invention comprise both an outer glove and an inner glove, with the inner glove being generally inserted into the outer-glove so that the fingertips of the inner glove protrude beyond the open-end tubes of the outer glove. In one embodiment the inner glove is removable from the outer glove. However the inner and outer gloves may be mutually attached to each other and in this embodiment the inner glove will not be removable. The glove of the present invention is therefore properly considered as a two glove protective pair.

The protective glove pair of the present invention provides protection from heat and abrasion provides enhanced gripping by means of the outer glove and also provides protection against chemical solvents and harsh chemicals by means of the inner glove. The fingertips of the inner glove protrude beyond the open-end portions of the outer glove thereby increasing exposure of the palmar fingertip surfaces which have increased sensitivity relative to other portions of the hand. The fingertips when inserted into the inner glove are protected against chemical solvents and toxic chemicals but yet allow a "fingertip feel" ability for the manipulation of small instruments and the performance of tasks which require tactile sensitivity.

The outer glove of the present glove pair is generally designed to cover both the dorsal and palmar surfaces of the body of the hand, thereby protecting the hand from abrasion, cuts, etc. in this area of the hand. The outer glove also provides thermal protection when grasping hot articles such as chemical glassware and chemical process equipment. In some applications, such as for gloves used in the assembly of electronic devices, the dorsal side of the outer glove may be open. A portion of the glove body may extend down the wrist to provide a better fit and increased heat resistance to this area of the hand and wrist. Alternatively, the glove body may be fitted with a closure means for adjusting the diameter of the wrist portion of the glove. Suitable adjustment means are well known and are described, for example, in U.S. Pat. No. 2,314,545 utilizing a strap and buckle means, as well as U.S. Pat. No. 4,519,097 utilizing a flap fitted with a VELCRO hook and loop fastener. These embodiments and other conventional means for adjusting the wrist portion of the glove to fit a particular sized wrist are well known to those in the art. The outer glove of the present invention may be fitted with any conventionally known means for adjusting the fit of the glove to the wearer's wrist to ensure a snug fit.

The outer glove also provides protection for the fingers by means of tubular open-ended projections from the glove body. The tubular protective portions of the outer glove extend to a point between the metacarpophalangeal joints to the distal-knuckles of each of the four fingers and thumb. The specific length of the protective finger and thumb portions will be determined by the particular application for which the glove is designed. For example, in applications in which the fingers will not be subjected to substantial abrasion, shock or heat, the finger and thumb portions of the outer glove may be relatively small, that is, extending only a portion of the distance of the proximal phalanx of each finger and thumb. If desired, the tubular finger and thumb portions of the outer glove may be eliminated entirely so that the outer glove comprises only a glove body with openings for each of the four fingers and thumb.

Alternatively, in applications in which the fingers are subjected to high temperature objects or substantial abrasion, the protective finger and thumb portions may extend up to the distal knuckle of each finger and thumb thereby providing substantially more protection to each of the digits. In each of these applications, however, the inner glove will protrude through the open end of the protective finger and thumb portions providing tactile sensitivity to the palmar finger surfaces.

In a particularly interesting embodiment, the finger and thumb protective portions are provided with identified segments which may be cut or removed by the user to provide protective portions of the desired length. These identified segments may be partially cut, i.e., perforated, or may simply be marked for appropriate cutting by the user. In this embodiment the finger and thumb protective portions may initially cover the entire finger and thumb. In this way, the user can select the degree of exposure of each finger and thumb which is desired for a particular application.

The outer glove can be made from leather or a durable natural material or fabric or a synthetic fiber fabric. Leather provides increased thermal and abrasion resistance whereas textile fabrics are more flexible and are form-fitting which is desirable for certain applications. The outer glove material should be of sufficient thickness to protect the hand from excess temperatures and yet be sufficiently flexible to allow for manual dexterity in handling objects and equipment. The particular thickness of the leather or fabric can be readily determined by those skilled in the art for the particular application desired.

Suitable examples of fabrics include natural fiber fabrics, such as cotton or wool, as well as synthetic fibers such as nylon, polyesters, acrylics, polypropylene, for example, and conventional polyblends of two or more fabrics. The fabric may be woven or knit as desired. Any synthetic or natural material which can be formed into a fabric may be utilized for the outer glove. Preferred fabrics include nylon, polyester, rayon, leather, cotton, wool and polyblends thereof.

The palmar area of the body of the outer glove may be provided with one or more layers of additional material appropriately attached to the palmar area, for the purpose of increasing the frictional characteristics and absorbancy (for example to absorb excess oil) of the palmar surface of the glove, thereby increasing the gripping and holding potential of the glove. For example, the palmar area may contain an additional layer made of roughened leather or interlocking layer made of roughened leather or interlocking nylon to provide the additional traction, friction and absorbancy required.

The additional material may be permanently attached, for example, by stitching or may be removably attached, for example, by detachable adhesive backing for easier replacement. The additional piece may also optionally extend up the inner finger portion of the outer protective glove.

The inner glove is preferably made of natural or synthetic rubbers or synthetic polymers. The inner glove should be of a flexible nature such that the inner glove fits the hand and completely covers the fingers and fingertips with a skin-tight fit thereby providing support to the hand and a snug and pleasurable feeling. The inner glove may be made of natural or synthetic rubber compositions, for example silicone rubber, or a synthetic polymer such as polyethylene or TEFLON, or may be made of a polyurethane such as that described in U.S. Pat. No. 4,463,156 incorporated herein by reference. Any rubber or synthetic polymer which is known for use in making flexible solvent resistant gloves is considered to be within the scope of the present invention. The inner glove can be made by blow molding or other suitable means of manufacture.

For chemical applications, the inner glove should be nonporous and should be impermeable to organic solvents and harsh chemicals. It is not necessary, however, that the inner glove be constructed of a nonporous material. For example, in applications which do not require protection of the hand from harsh chemicals or solvents, the inner glove may be constructed to be porous thereby allowing the skin to "breath" through the inner glove.

The inner glove is preferably constructed so as to fit removably within the outer glove with the fingertip portions of the inner glove extending beyond the open fingertips of the outer glove. The degree of removability will depend on the particular application for which the gloves are intended. For example, the inner glove may be held in place within the outer glove by means of the frictional resistance between the inner and outer gloves, thereby providing easy removal of the inner glove from the outer glove. Such an embodiment is particularly useful in harsh chemical environments in which one wishes to replace the inner glove with a new inner glove while retaining the original outer glove of the protective glove pair.

More substantial mutual attachment of the inner glove to the outer glove is possible by means of interstitching the inner and outer gloves at the wrist portion of the glove pair. Additional points of attachment can, of course, be provided in any area of the inner and outer glove if desired. Other means of attaching the inner glove to the outer glove include heat fusing the two gloves together, gluing, VELCRO attachments, etc.

For some applications, in particular medical uses, the relative position of the inner and outer gloves may be exchanged in the protective glove pair of the present invention. That is, when it is desirable, for example, to sterilize the outer glove and yet still provide additional protection for the body of the hand while retaining fingertip sensitivity, the outer glove may be placed within the inner glove. In this embodiment, the structures of the inner and outer glove and the materials from which the inner and outer gloves may be made are the same as described above.

For example, in this embodiment in which the outer glove is worn next to the skin and is covered by the inner glove, a nylon fabric outer glove having open-ended finger and thumb protective portions is located or inserted within a thin latex rubber or polyurethane inner glove. The inner glove, which is now worn over the top of the outer glove, covers the fingers and fingertips of the hand. This "inverse" embodiment allows for a sterile rubber or polyurethane glove which contacts the patient. Fingertip sensitivity is maintained while providing additional protection against accidental cuts and puncture wounds to the hand which may occur during surgery or medical procedures. This application is particularly important in view of the serious consequences which may result from exposure to infected blood or body fluids typically encountered in hospital settings.

Obviously, numerous modifications and variations of the present invention are possible in light of the above teachings. It is therefore to be understood that within the scope of the appended claims, the invention may be practiced otherwise than as specifically described herein.

What is claimed as new as desired to be secured by Letters Patent of the U.S. is:

1. A protective glove pair, comprising:

an outer glove and an inner glove within said outer glove, wherein said inner and outer gloves are substantially mutually attached to each other, wherein said outer glove comprises a glove body and protective finger and thumb portions, said protective portions comprising open-ended tubes from the glove body to cover each of the fingers and thumb to a distance between the metacarpophalangeal joints and the distal knuckle of each finger and thumb, and said inner glove is flexible and tight fitting to the hand and comprises a natural or synthetic rubber or synthetic polymer.

2. The protective glove pair of claim 1, wherein said outer glove comprises an adjustment means for adjusting the fit of the outer glove to the wearers wrist.

3. The protective glove pair of claim 1, wherein said outer glove is comprised of leather or a durable, natural or synthetic fiber fabric.

4. The protective glove pair of claim 1, wherein the protective finger and thumb portions of said outer glove are provided with removable identified segments which may be cut or removed to provide the desired length of said open-ended tubes.

5. The protective glove pair of claim 1, wherein the palmar area of the body of said outer glove is provided with one or more layers of additional material to increase the frictional characteristics or absorbancy of the palmar surface of the outer glove.

6. The protective glove pair of claim 5, wherein said additional material comprises roughened leather or interlocking nylon, or other absorbent material.

* * * * *